US009873179B2

(12) United States Patent
Chen et al.

(10) Patent No.: US 9,873,179 B2
(45) Date of Patent: Jan. 23, 2018

(54) CARRIER FOR SMALL PAD FOR CHEMICAL MECHANICAL POLISHING

(71) Applicant: Applied Materials, Inc., Santa Clara, CA (US)

(72) Inventors: Hui Chen, San Jose, CA (US); Steven M. Zuniga, Soquel, CA (US); Hung Chih Chen, Sunnyvale, CA (US); Eric Lau, Santa Clara, CA (US); Garrett Ho Yee Sin, Sunnyvale, CA (US); Shou-Sung Chang, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 49 days.

(21) Appl. No.: 15/002,193

(22) Filed: Jan. 20, 2016

(65) Prior Publication Data

US 2017/0203405 A1 Jul. 20, 2017

(51) Int. Cl.
*B24B 37/20* (2012.01)
*B24B 37/30* (2012.01)

(52) U.S. Cl.
CPC ..... *B24B 37/20* (2013.01); *B24B 37/30* (2013.01)

(58) Field of Classification Search
CPC ..... B24B 37/20; B24B 37/30; B24B 7/10; B24B 7/16; B24B 27/0023; B24B 37/08
USPC ..... 451/288, 289, 290
See application file for complete search history.

(56) References Cited

U.S. PATENT DOCUMENTS

| | | | | |
|---|---|---|---|---|
| 5,020,283 | A | 6/1991 | Tuttle | |
| 5,177,908 | A | 1/1993 | Tuttle | |
| 5,297,364 | A | 3/1994 | Tuttle | |
| 5,310,455 | A * | 5/1994 | Pasch | B24B 37/22 156/211 |
| 5,582,534 | A | 12/1996 | Shendon et al. | |
| 5,584,746 | A * | 12/1996 | Tanaka | B24B 37/30 451/288 |

(Continued)

FOREIGN PATENT DOCUMENTS

| | | |
|---|---|---|
| JP | 10-329012 | 12/1998 |
| JP | 2002-103211 | 4/2002 |
| KR | 10-2002-0091325 | 12/2002 |

OTHER PUBLICATIONS

International Search Report and Written Opinion in International Application No. PCT/US2016/064541, dated Mar. 16, 2017, 9 pages.

*Primary Examiner* — George Nguyen
(74) *Attorney, Agent, or Firm* — Fish & Richardson P.C.

(57) ABSTRACT

A chemical mechanical polishing system includes a substrate support configured to hold a substrate during a polishing operation, a polishing pad assembly include a membrane and a polishing pad portion, a polishing pad carrier, and a drive system configured to cause relative motion between the substrate support and the polishing pad carrier. The polishing pad carrier includes a casing having a cavity and an aperture connecting the cavity to an exterior of the casing. The polishing pad assembly is positioned in the casing such that the membrane divides the cavity into a first chamber and a second chamber and the aperture extends from the second chamber. The polishing pad carrier and polishing pad assembly are positioned and configured such that at least during application of a sufficient pressure to the first chamber the polishing pad portion projects through the aperture.

21 Claims, 7 Drawing Sheets

(56) References Cited

U.S. PATENT DOCUMENTS 5,851,140 A * 12/1998 Barns ..... B24B 37/32 451/288
5,921,855 A 7/1999 Osterheld et al.
5,938,504 A 8/1999 Talieh
6,162,116 A * 12/2000 Zuniga ..... B24B 37/32 451/285
6,241,585 B1 6/2001 White
6,315,641 B1 11/2001 Lee et al.
6,464,574 B1 10/2002 Halley
6,494,774 B1 * 12/2002 Zuniga ..... B24B 37/30 451/288
6,517,419 B1 2/2003 Halley
6,793,565 B1 9/2004 Chadda et al.
6,855,043 B1 * 2/2005 Tang ..... B24B 37/32 451/288
6,857,945 B1 * 2/2005 Chen ..... B24B 37/30 451/288
7,001,245 B2 * 2/2006 Chen ..... B24B 37/30 451/288
7,101,271 B2 * 9/2006 Moon ..... B24B 37/30 451/285
2001/0019934 A1 * 9/2001 Nishimura ..... B24B 37/04 451/8
2002/0132566 A1 9/2002 Jeong
2003/0168169 A1 9/2003 Ishikawa
2004/0127051 A1 * 7/2004 Lee ..... B24B 37/042 438/692
2008/0293332 A1 11/2008 Watanabe et al.
2012/0171933 A1 7/2012 Chen et al.
2014/0209239 A1 7/2014 Ko
2015/0111478 A1 4/2015 Chen
2016/0016280 A1 1/2016 Chen et al.
2016/0016281 A1 1/2016 Chen
2016/0016282 A1 1/2016 Chen

* cited by examiner

CARRIER FOR SMALL PAD FOR CHEMICAL MECHANICAL POLISHING

TECHNICAL FIELD

This disclosure relates to chemical mechanical polishing (CMP).

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

SUMMARY

The present disclosure provides an apparatus for polishing of substrates in which the contact area of the polishing pad against the substrate is smaller than the radius of the substrate.

In one aspect, a chemical mechanical polishing system includes a substrate support configured to hold a substrate during a polishing operation, a polishing pad assembly include a membrane and a polishing pad portion, a polishing pad carrier, and a drive system configured to cause relative motion between the substrate support and the polishing pad carrier. The polishing pad portion has a polishing surface to contact the substrate during the polishing operation, and the polishing pad portion is joined to the membrane on a side opposite the polishing surface. The polishing pad carrier includes a casing having a cavity and an aperture connecting the cavity to an exterior of the casing. The polishing pad assembly is positioned in the casing such that the membrane divides the cavity into a first chamber and a second chamber and the aperture extends from the second chamber. The polishing pad carrier and polishing pad assembly are positioned and configured such that at least during application of a sufficient pressure to the first chamber the polishing pad portion projects through the aperture.

Implementations may include one or more of the following features.

The membrane and the polishing pad portion may be a unitary body. The polishing pad portion may be secured to the membrane by an adhesive. The membrane may include a first portion surrounded by a less flexible second portion, and the polishing pad portion may be joined to the first portion. An exterior surface of the polishing pad carrier surrounding the aperture may be substantially parallel to the polishing surface.

The polishing pad carrier and polishing pad assembly may be configured such that when the first chamber is at atmospheric pressure the polishing pad portion extends at least partially through the aperture. The polishing pad carrier and polishing pad assembly may be configured such that when the first chamber is at atmospheric pressure the polishing pad portion extends entirely through the aperture. The polishing pad carrier and polishing pad assembly may be configured such that when the first chamber is at atmospheric pressure the polishing pad portion extends only partially through the aperture.

A controllable pressure source may be fluidically coupled to the first chamber. A reservoir for polishing fluid may be fluidically coupled to the second chamber. The system may be configured to cause the polishing fluid to flow into the second chamber and out of the aperture during a polishing operation. A source of cleaning fluid may be fluidically coupled to the second chamber. The system may be configured to cause the cleaning fluid to flow into the second chamber and out of the aperture between polishing operations.

The casing may include a lower portion that extends across substantially all of the membrane except at the aperture. The casing may include an upper portion, and edges of the membrane are clamped between the upper portion and the lower portion of the casing. The membrane may be substantially parallel to the polishing surface. The drive system may be configured to move the polishing pad carrier in an orbital motion while the polishing pad portion is in contact with an exposed surface of the substrate and to maintain the polishing pad in a fixed angular orientation relative to the substrate during the orbital motion.

In another aspect, a polishing pad assembly may include a membrane having a perimeter with a kidney-bean shape, and a polishing pad portion having a polishing surface to contact the substrate during the polishing operation. The polishing pad portion may be joined to the membrane on a side opposite the polishing surface.

Implementations may include one or more of the following features.

The polishing pad portion may be positioned about at a midline of the membrane and substantially equidistance from opposing edges of the membrane. The membrane may have bilateral symmetry across a midline of the membrane.

Advantages of the invention may include one or more of the following. The pressure of the polishing pad against the substrate can be controlled, thus permitting adjustment of the polishing rate by the polishing pad. The membrane holding the polishing pad can be protected from polishing debris, thus improving the lifetime of the pad part. Slurry can be provided in close proximity to the portion of the polishing pad that contacts the substrate. This permits slurry to be supplied in lower quantity, thus reducing cost. A small pad that undergoes an orbiting motion can be used to compensate for non-concentric polishing uniformity. The orbital motion can provide an acceptable polishing rate while avoiding overlap of the pad with regions that are not desired to be polished, thus improving substrate uniformity. Non-uniform polishing of the substrate can be reduced, and the resulting flatness and finish of the substrate are improved.

Other aspects, features, and advantages of the invention will be apparent from the description and drawings, and from the claims.

DESCRIPTION OF DRAWINGS

Like reference symbols in the various drawings indicate like elements.

DETAILED DESCRIPTION

1. Introduction

Some chemical mechanical polishing processes result in thickness non-uniformity across the surface of the substrate. For example, a bulk polishing process can result in underpolished regions on the substrate. To address this problem, after the bulk polishing it is possible to perform a "touch-up" polishing process that focuses on portions of the substrate that were underpolished.

Some bulk polishing processes result in localized non-concentric and non-uniform spots that are underpolished. A polishing pad that rotates about a center of the substrate may be able to compensate for concentric rings of non-uniformity, but may not be able to address localized non-concentric and non-uniform spots. However, a small pad that undergoes an orbiting motion can be used to compensate for non-concentric polishing non-uniformity.

Figure 1:
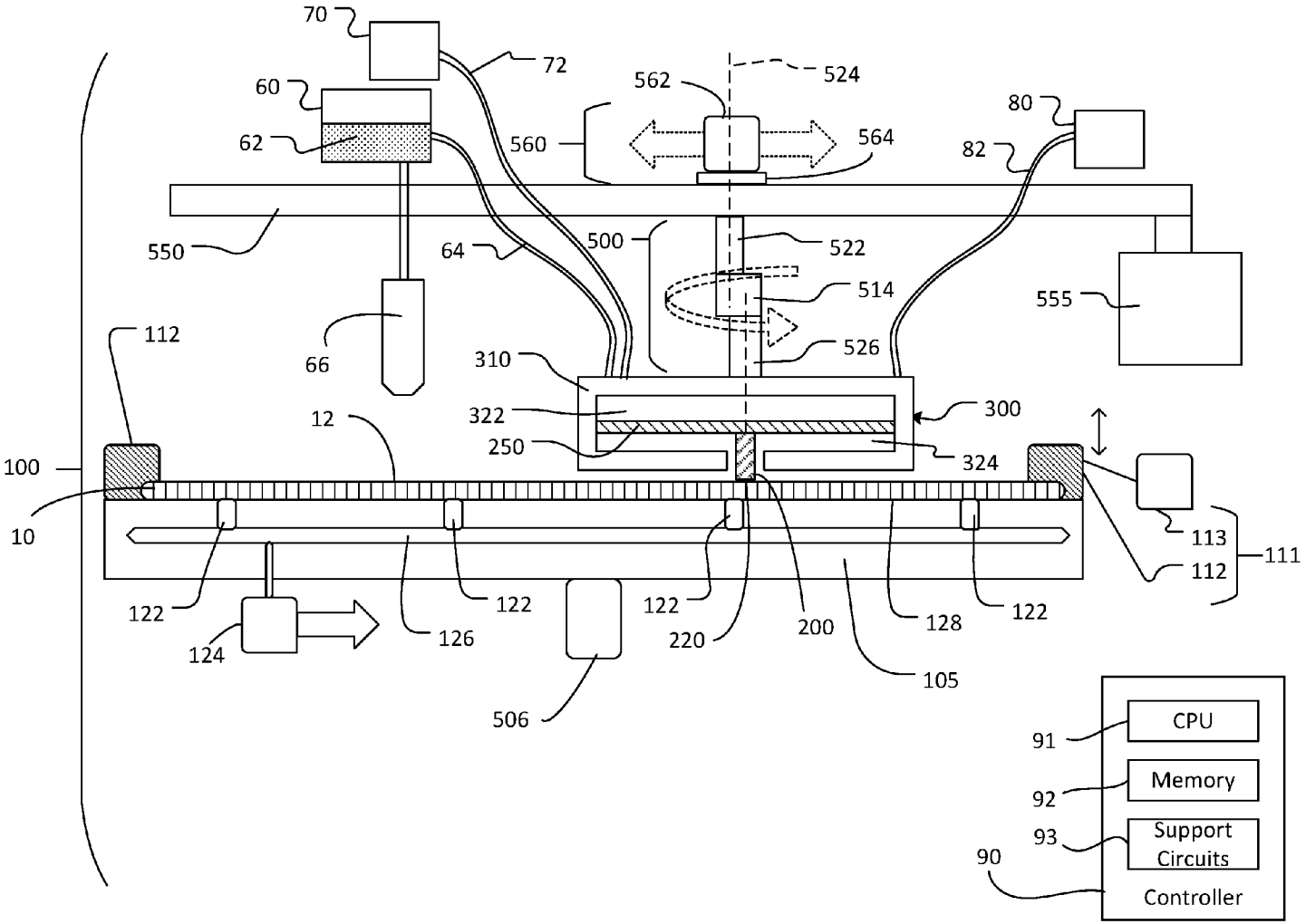
FIG. 1 is a schematic cross-sectional side view of a polishing system.

Referring to FIG. 1, a polishing apparatus 100 for polishing localized regions of the substrate includes a substrate support 105 to hold a substrate 10, and a movable polishing pad carrier 300 to hold a polishing pad portion 200. The polishing pad portion 200 includes a polishing surface 220 that has a smaller diameter than the radius of the substrate 10 being polished.

The polishing pad carrier 300 is suspended from a polishing drive system 500 which will provide motion of the polishing pad carrier 300 relative to the substrate 10 during a polishing operation. The polishing drive system 500 can be suspended from a support structure 550.

In some implementations, a positioning drive system 560 is connected to the substrate support 105 and/or the polishing pad carrier 300. For example, the polishing drive system 500 can provide the connection between the positioning drive system 560 and the polishing pad carrier 300. The positioning drive system 560 is operable to position the pad carrier 300 at a desired lateral position above the substrate support 105.

For example, the support structure 550 can include two linear actuators 562 and 564, which are oriented to provide motion in two perpendicular directions over the substrate support 105, to provide the positioning drive system 560. Alternatively, the substrate support 105 could be supported by the two linear actuators. Alternatively, the substrate support 105 could be supported by one linear actuator and the polishing pad carrier 300 could be supported by the other linear actuator. Alternatively, the substrate support 105 can be rotatable, and the polishing pad carrier 300 can be suspended from a single linear actuator that provides motion along a radial direction. Alternatively, the polishing pad carrier 300 can be suspended from a rotary actuator and the substrate support 105 can be rotatable with a rotary actuator. Alternatively, the support structure 550 can be an arm that is pivotally attached to a base located off to the side of the substrate 105, and the substrate support 105 could be supported by a linear or rotary actuator.

Optionally, a vertical actuator can be connected to the substrate support 105 and/or the polishing pad carrier 300. For example, the substrate support 105 can be connected to a vertically drivable piston 506 that can lift or lower the substrate support 105. Alternatively or in addition, a vertically drivable piston could be included in the positioning system 500 so as to lift or lower the entire polishing pad carrier 300.

The polishing apparatus 100 optionally includes a reservoir 60 to hold a polishing liquid 62, such as an abrasive slurry. As discussed below, in some implementations the slurry is dispensed through the polishing pad carrier 300 onto the surface 12 of the substrate 10 to be polished. A conduit 64, e.g. flexible tubing, can be used to transport the polishing fluid from the reservoir 60 to the polishing pad carrier 300. Alternatively or in addition, the polishing apparatus could include a separate port 66 to dispense the polishing liquid. The polishing apparatus 100 can also include a polishing pad conditioner to abrade the polishing pad 200 to maintain the polishing pad 200 in a consistent abrasive state. The reservoir 60 can include a pump to supply the polishing liquid at a controllable rate through the conduit 64.

The polishing apparatus 100 can include a source 70 of cleaning fluid, e.g., a reservoir or supply line. The cleaning fluid can be deionized water. A conduit 72, e.g., flexible tubing, can be used to transport the polishing fluid from the reservoir 70 to the polishing pad carrier 300.

The polishing apparatus 100 includes a controllable pressure source 80, e.g., a pump, to apply a controllable pressure to the interior of the polishing pad carrier 300. The pressure source 80 can be connected to the polishing pad carrier 300 by a conduit 82, such as flexible tubing.

Each of the reservoir 60, cleaning fluid source 70 and controllable pressure source 80 can be mounted on the support structure 555 or on a separate frame holding the various components of the polishing apparatus 100.

In operation, the substrate 10 is loaded onto the substrate support 105, e.g., by a robot. In some implementations, the positioning drive system 560 moves the polishing pad carrier 500 such that the polishing pad carrier 500 is not directly above the substrate support 105 when the substrate 10 is loaded. For example, if the support structure 550 is a pivotable arm, the arm could swing such that the polishing pad carrier 300 is off to the side of the substrate support 105 during substrate loading.

Then the positioning drive system 560 positions the polishing pad support 300 and polishing pad 200 at a desired position on the substrate 10. The polishing pad 200 is brought into contact with the substrate 10. For example, the polishing pad carrier 300 can actuate the polishing pad 200 to press it down on the substrate 10. Alternatively or in addition, one or more vertical actuators could lower the entire polishing pad carrier 300 and/or lift the substrate support to bring into contact with the substrate 10. The polishing drive system 500 generates the relative motion between the polishing pad support 300 and the substrate support 105 to cause polishing of the substrate 10.

During the polishing operation, the positioning drive system 560 can hold the polishing drive system 500 and substrate 10 substantially fixed relative to each other. For example, the positioning system can hold the polishing drive system 500 stationary relative to the substrate 10, or can sweep the polishing drive system 500 slowly (compared to the motion provided to the substrate 10 by the polishing drive system 500) across the region to be polished. For example, the instantaneous velocity provided to the substrate 10 by the positioning drive system 560 can be less than 5%, e.g., less than 2%, of the instantaneous velocity provided to the substrate 10 by the polishing drive system 500.

The polishing system also includes a controller 90, e.g., a programmable computer. The controller can include a central processing unit 91, memory 92, and support circuits 93. The controller's 90 central processing unit 91 executes instructions loaded from memory 92 via the support circuits 93 to allow the controller to receive input based on the environment and desired polishing parameters and to control the various actuators and drive systems.

2. The Substrate Support

Referring to FIG. 1, the substrate support 105 is plate-shaped body situated beneath the polishing pad carrier 300. The upper surface 128 of the body provides a loading area large enough to accommodate a substrate to be processed. For example, the substrate can be a 200 to 450 mm diameter substrate. The upper surface 128 of the substrate support 105 contacts the back surface of the substrate 10 (i.e., the surface that is not being polished) and maintains its position.

The substrate support 105 is about the same radius as the substrate 10, or larger. In some implementations, the substrate support 105 is slightly narrower than the substrate, e.g., by 1-2% of the substrate diameter. In this case, when placed on the support 105, the edge of the substrate 10 slightly overhangs the edge of the support 105. This can provide clearance for an edge grip robot to place the substrate on the support. In some implementations, the substrate support 105 is wider than the substrate, e.g., by 1-10% of the substrate diameter. In either case, the substrate support 105 can make contact with a majority of the surface the backside of the substrate.

In some implementations, the substrate support 105 maintains the substrate 10 position during polishing operation with a clamp assembly 111. For example, the clamp assembly 111 can be where the substrate support 105 is wider than the substrate 10. In some implementations, the clamp assembly 111 can be a single annular clamp ring 112 that contacts the rim of the top surface of the substrate 10. Alternatively, the clamp assembly 111 can include two arc-shaped clamps 112 that contact the rim of the top surface on opposite sides of the substrate 10. The clamps 112 of the clamp assembly 111 can be lowered into contact with the rim of the substrate by one or more actuators 113. The downward force of the clamp restrains the substrate from moving laterally during polishing operation. In some implementations, the clamp(s) include downwardly a projecting flange 114 that surrounds the outer edge of the substrate.

Alternatively or in addition, the substrate support 105 is a vacuum chuck. In this case, the top surface 128 of the support 105 that contacts the substrate 10 includes a plurality of ports 122 connected by one or more passages 126 in the support 105 to a vacuum source 126, such as a pump. In operation, air can be evacuated from the passages 126 by the vacuum source 126, thus applying suction through the ports 122 to hold the substrate 10 in position on the substrate support 105. The vacuum chuck can be whether the substrate support 105 is wider or narrower than the substrate 10.

In some implementations, the substrate support 105 includes a retainer to circumferentially surround the substrate 10 during polishing. The various substrates support features described above can be optionally be combined with each other. For example, the substrate support can include both a vacuum chuck and a retainer.

3. The Polishing Pad

Figure 2:
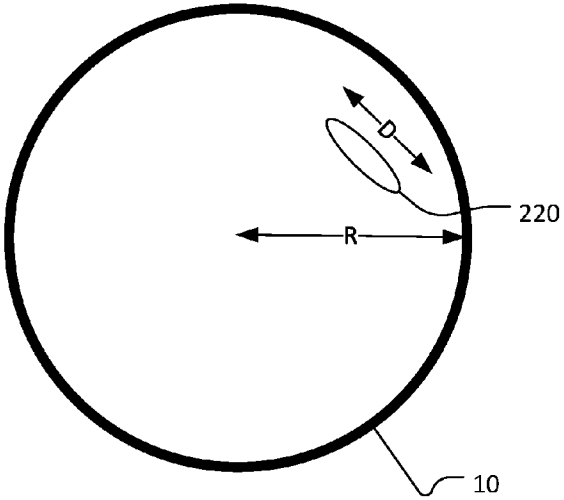
FIG. 2 is a schematic top view illustrating a loading area of a polishing pad portion on a substrate.

Referring to FIGS. 1 and 2, the polishing pad portion 200 has a polishing surface 220 that is brought into contact with the substrate 10 in a contact area, also called a loading area, during polishing. The polishing surface 220 can have a largest lateral dimension D that is smaller diameter than the radius of the substrate 10. For example, for the largest lateral diameter of the polishing pad can be about can be about 5-10% of the diameter of the substrate. For example, for wafer that ranges from 200 mm to 300 mm in diameter, the polishing pad surface 220 can have a largest lateral dimension of 2-30 mm, e.g., 3-10 mm, e.g., 3-5 mm. Smaller pads provide more precision but are slower to use.

The lateral cross-sectional shape, i.e., a cross-section parallel to the polishing surface 220, of the polishing pad portion 200 (and the polishing surface 220) can be nearly any shape, e.g., circular, square, elliptical, or a circular arc.

Referring to FIGS. 1 and 3A-3D, the polishing pad portion 200 is joined to a membrane 250 to provide a polishing pad assembly 240. As discussed below, the membrane 250 is configured to flex, such that a central area 252 of the membrane 250 to which the polishing pad portion 200 is joined can undergo vertical deflection while the edges 254 of the membrane 250 remain vertically stationary.

The membrane 250 has a lateral dimension L that is larger than the largest lateral dimension D of the polishing pad portion 200. The membrane 250 can be thinner than the polishing pad portion 200. The side walls 202 of the polishing pad portion 200 can extend substantially perpendicular to the membrane 250.

Figure 3A:
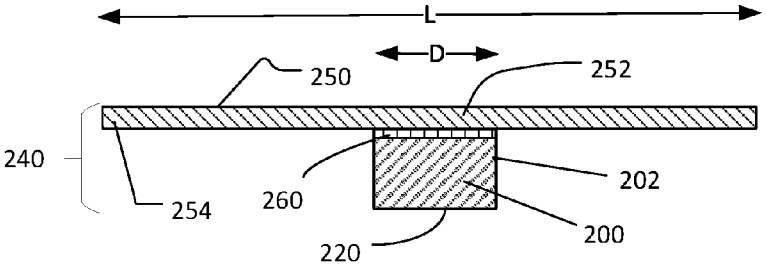
FIGS. 3A-3E are schematic cross-sectional views of a polishing pad assembly.

In some implementations, e.g., as shown in FIG. 3A, the top of the polishing pad portion 200 is secured to the bottom of the membrane 250 by an adhesive 260. The adhesive can be an epoxy, e.g., a UV-curable epoxy. In this case, the polishing pad portion 200 and membrane 250 can be fabricated separately, and then joined together.

Figure 3B:
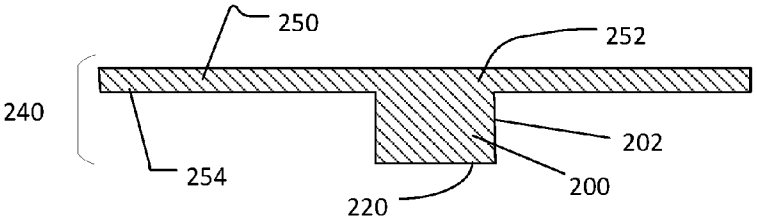

In some implementations, e.g., as shown in FIG. 3B, the polishing pad assembly, including the membrane 250 and the polishing pad portion 200, is a single unitary body, e.g., of homogenous composition. For example, the entire polishing pad assembly 250 can be formed by injection molding in a mold having the complementary shape. Alternatively, the polishing pad assembly 240 could be formed in a block, and then machined to thin the section corresponding to the membrane 250.

The polishing pad portion 200 can be a material suitable for contacting the substrate during chemical mechanical polishing. For example, the polishing pad material can include polyurethane, e.g., a microporous polyurethane, for example, an IC-1000 material.

Where the membrane 250 and polishing pad portion 200 are formed separately, the membrane 250 can be softer than the polishing pad material. For example, the membrane 250 can have a hardness of about 60-70 Shore D, whereas the polishing pad portion 200 can have a hardness of about 80-85 Shore D.

Alternatively the membrane 250 can be more flexible, but less compressible, than the polishing pad portion 200. For example, the membrane can be a flexible polymer, such as polyethylene terephthalate (PET).

The membrane 250 can formed of a different material than the polishing pad portion 200, or can be formed of the essentially the same material but with a different degree of cross-linking or polymerization. For example, both the membrane 250 and the polishing pad portion 200 can be polyurethane, but the membrane 250 can be cured less than the polishing pad portion 200 such that it is softer.

Figure 3C:
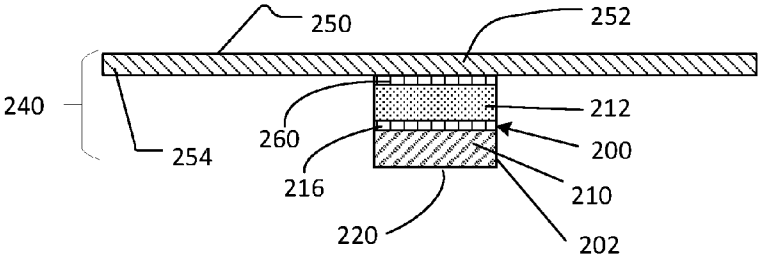

In some implementations, e.g., as shown in FIG. 3C, the polishing pad portion 200 can include two or more layers of different composition, e.g., a polishing layer 210 having the polishing surface 220, and a more compressible backing layer 212 between the membrane 250 and the polishing layer 210. Optionally, an intermediate adhesive layer 26, e.g., a pressure sensitive adhesive layer, can be used to secure the polishing layer 210 to the backing layer 212.

The polishing pad portion having multiple layers of different composition is also applicable to the implementation shown in FIG. 3B. In this case the membrane 250 and the backing layer 212 can be is a single unitary body, e.g., of homogenous composition. So the membrane 250 is a portion of the backing layer 212.

Figure 3D:
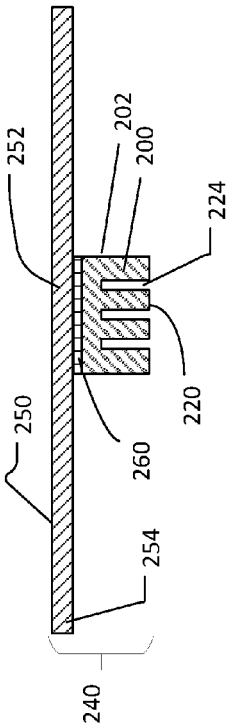

In some implementations, as shown in FIG. 3D (but also applicable to the implementations shown in FIGS. 3B and 3C), the bottom surface of the polishing pad portion 200 can include grooves 224 to permit transport of slurry during a polishing operation. The grooves 224 can be shallower than the depth of the polishing pad portion 200 (e.g., shallower than the polishing layer 210).

Figure 3E:
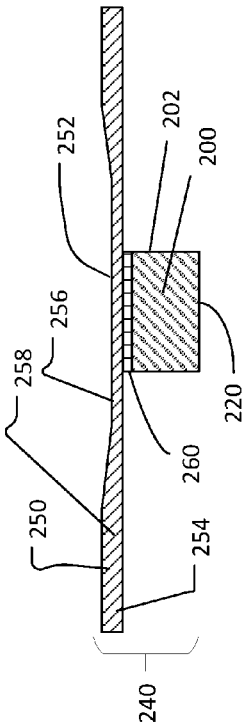

In some implementations, e.g., as shown in FIG. 3E (but also applicable to the implementations shown in FIGS. 3B-3E), the membrane 250 includes a thinned section 256 around the central section 252. The thinned section 256 is thinner than a surrounding portion 258. This increases flexibility of the membrane 200 to permit greater vertical deflection under applied pressure.

The perimeter 254 of the membrane 250 can include a thickened rim or other features to improve sealing to the polishing pad carrier 300.

Figure 4A:
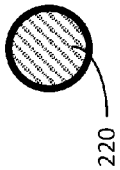
FIGS. 4A-4C are schematic bottom views of the polishing surface of a polishing pad assembly.

A variety of geometries are possible for the lateral cross-sectional shape of the polishing surface 220. Referring to FIG. 4A, the polishing surface 220 of the polishing pad portion 200 can be a circular area.

Figure 4B:
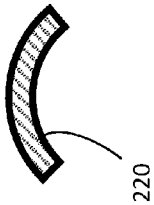

Referring to FIG. 4B, the polishing surface 220 of the polishing pad portion 200 can be an arc-shaped area. If such a polishing pad includes grooves, the grooves can extend entirely through the width of the arc-shaped area. The width is measured along the thinner dimension of the arc-shaped area. The grooves can be spaced at uniform pitch along the length of the arc-shaped area. Each grooves can extend along a radius that passes through the groove and the center of the arc-shaped area, or be positioned at an angle, e.g., 45°, relative to the radius.

Figure 4C:
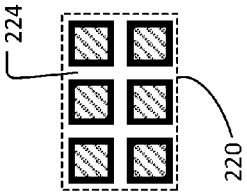

Referring to FIG. 4C, the polishing surface 220 of the polishing pad portion 200 is basically rectangular, but is shown divided by the grooves 224. As shown, there can be grooves running in perpendicular directions across the polishing surface 220, but in some implementations, e.g., if the polishing surface 220 is sufficiently narrow, all the grooves can run in just one direction.

Referring to FIG. 1, the largest lateral dimension of the membrane 250 is smaller than the smallest lateral dimension of the substrate support 105. Similarly, the largest lateral dimension of the membrane 250 is smaller than the smallest lateral dimension of the substrate 10.

Figure 5B:
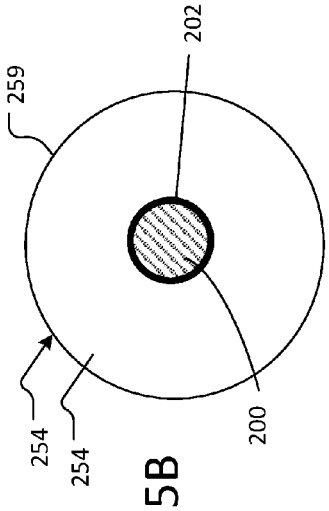
FIGS. 5A-5B are schematic bottom views of a polishing pad assembly.
Figure 5A:
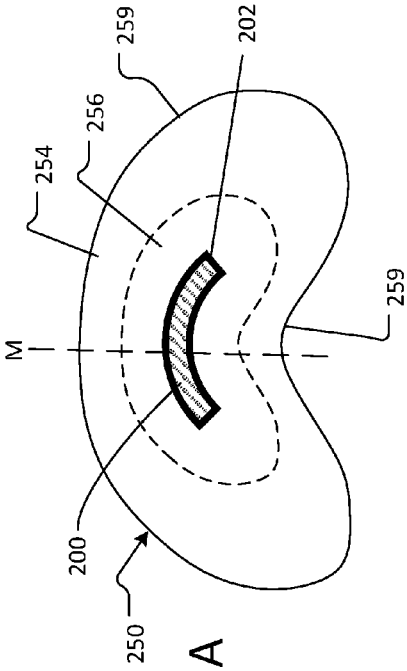

Referring to FIGS. 5A and 5B, the membrane 250 extends beyond the outer side walls 202 of the polishing pad portion 200 on all sides of the polishing pad portion 200. The polishing pad portion 200 can be equidistant from the two closest opposing edges of the membrane 250. The polishing pad portion 200 can be located in the center of the membrane 250.

The smallest lateral dimension of the membrane 250 can be about five to fifty times larger than the corresponding lateral dimension of the polishing pad portion. The smallest (lateral) circumference dimension of the membrane 250 can be about 260 mm to 300 mm. In general, the size of the membrane 250 depends on its flexibility; the size can be selected such that the center of the membrane undergoes a desired amount of vertical deflection at a desired pressure.

The pad portion 200 can have a thickness of about 0.5 to 7 mm, e.g., about 2 mm. The membrane 250 can have a thickness of about 0.125 to 1.5 mm, e.g., about 0.5 mm.

The perimeter 259 of the membrane 250 can generally mimic the perimeter of the polishing pad portion. For example, as shown in FIG. 5B, if the polishing pad portion 200 is circular, the membrane 250 can be circular as well. However, the perimeter 259 of the membrane 250 can be smoothly curved so that it does not include sharp corners. For example, if the polishing pad portion 200 is square, the membrane 250 can be a square with rounded corners or a squircle. In some implementations, the perimeter 259 of the membrane 250 is a uniform distance from the perimeter of the polishing pad portion 200. That is, the distance between each point on the perimeter 259 of the membrane 250 and its nearest point on the perimeter of polishing pad portion 200 is constant.

Referring to FIG. 5A, in some implementations, the membrane 250 has a "kidney-bean" shape. That is, the membrane 250 can be an elongated elliptical with a concavity 290 extending inwardly on a long side of the shape, but without a concavity on the opposite side of the shape. The membrane 250 can be biaxially symmetric about the short axis of the shape. At the midline M, the polishing pad portion 200 can be equidistant from the two opposing edges of the membrane 250.

The "kidney-bean" shape can be used with the arc-shaped polishing pad portion 200. This can improve uniformity of pressure of the polishing surface 250 on the substrate. However, the "kidney-bean" shape could be used with other shapes of polishing pad portion 200, e.g., square or rectangular.

4. The Polishing Pad Carrier

Figure 6:
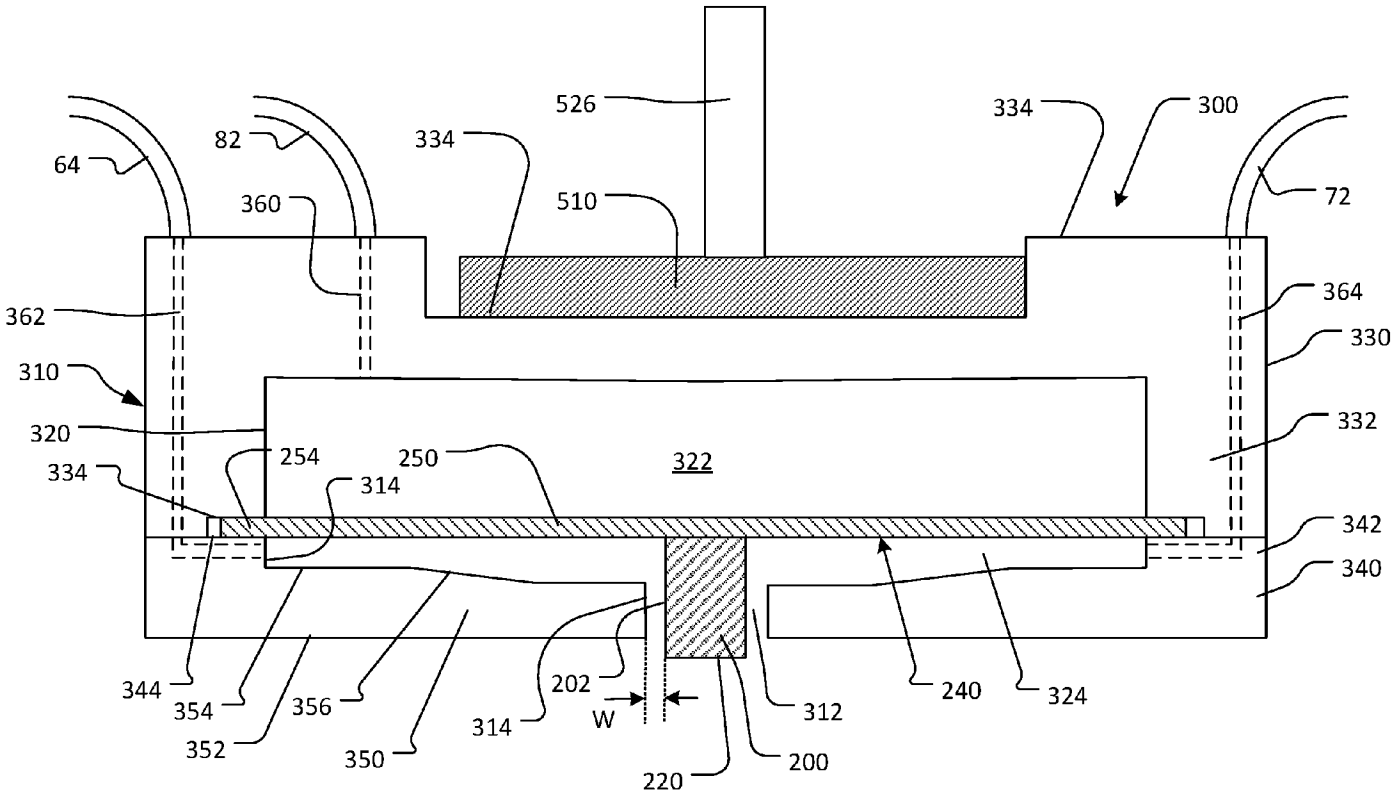
FIG. 6 is a schematic cross-sectional view of a polishing pad carrier.

Referring to FIG. 6, the polishing pad assembly 240 is held by the polishing pad carrier 300, which is configured to provide a controllable downward pressure on the polishing pad portion 200.

The polishing pad carrier includes a casing 310. The casing 310 can generally surround the polishing pad assembly 240. For example, the casing 310 can include an inner cavity in which at least the membrane 250 of the polishing pad assembly 250 is positioned.

The casing 310 also includes an aperture 312 into which the polishing pad portion 200 extends. The side walls 202 of the polishing pad 200 can be separated from the side walls 314 of the aperture 312 by a gap having a width W of, for example, about 0.5 to 2 mm. The side walls 202 of the polishing pad 200 can be parallel to the side walls 314 of the aperture 312.

The membrane 250 extends across the cavity 320 and divides the cavity 320 into a upper chamber 322 and a lower chamber 324. The aperture 312 connects the lower chamber 324 to the exterior environment. The membrane 254 can seal the upper chamber 320 so that it is pressurizable. For example, assuming the membrane 250 is fluid-impermeable, the edges 254 of the membrane 250 can be clamped to the casing 310.

In some implementations, the casing 310 includes an upper portion 330 and a lower portion 340. The upper portion 330 can include a downwardly extending rim 332 that will surround the upper chamber 322, and the lower portion 340 can include an upwardly extending rim 342 that will surround the lower chamber 342.

The upper portion 330 can be removably secured to the lower portion 340, e.g., by screws that extend through holes in the upper portion 330 into threaded receiving holes in the lower portion 340. Making the portions removably securable permits the polishing pad assembly 240 to be removed and replaced when the polishing pad portion 200 has been worn.

The edges 254 of the membrane 250 can be clamped between the upper portion 330 and the lower portion 340 of the casing 310. For example, the edge 254 of the membrane 250 is compressed between the bottom surface 334 of the rim 332 of the upper portion 330 and the top surface 342 of the rim 342 of the lower portion 340. In some implementations, either the upper portion 330 or the lower portion 332 can include a recessed region formed to receive the edge 254 of the membrane 250.

The lower portion 340 of the casing 310 includes a flange portion 350 that extends horizontal and inwardly from the rim 342. The lower portion 340, e.g., the flange 350, can extend across the entire membrane 250 except for the region of the aperture 312. This can protect the membrane 250 from polishing debris, and thus prolong the life of the membrane 250.

A first passage 360 in the casing 310 connects the conduit 82 to the upper chamber 322. This permits the pressure source 80 to control the pressure in the chamber 322, and thus the downward pressure on and deflection of the membrane 250, and thus the pressure of the polishing pad portion 200 on the substrate 10.

In some implementations, when the upper chamber 322 is at normal atmospheric pressure, the polishing pad portion extends 200 entirely through the aperture 312 and projects beyond the lower surface 352 of the casing 310. In some implementations, when the upper chamber 322 is at normal atmospheric pressure, the polishing pad portion 200 extends only partially into the aperture 312, and does not project beyond the lower surface 352 of the casing 310. However, in this later case, application of appropriate pressure to the upper chamber 322 can cause the membrane 250 to deflect such that the polishing pad portion 200 projects beyond the lower surface 352 of the casing 310.

An optional second passage 362 in the casing 310 connects the conduit 64 to the lower chamber 324. During a polishing operation, slurry 62 can flow from the reservoir 60 into the lower chamber 324, and out of the chamber 324 through the gap between the polishing pad portion 200 and the lower portion of the casing 310. This permits slurry to provided in close proximity to the portion of the polishing pad that contacts the substrate. Consequently, slurry can be supplied in lower quantity, thus reducing cost of operation.

An optional third passage 364 in the casing 310 connects the conduit 72 to the lower chamber 324. In operation, e.g., after a polishing operation, cleaning fluid can flow from the source 70 into the lower chamber 324. This permits the polishing fluid to be purged from the lower chamber 324, e.g., between polishing operations. This can prevent coagulation of slurry in the lower chamber 324, and thus improve the lifetime of the polishing pad assembly 240 and decrease defects.

A lower surface 352 of the casing 310, e.g., the lower surface of the flange 350, can extend substantially parallel to the top surface 12 of the substrate 10 during polishing. An upper surface 354 of the flange 344 can include a sloped area 356 that, measured inwardly, slopes away from the outer upper portion 330. This sloped area 356 can help ensure that the membrane 250 does not contact the inner surface 354 when the upper chamber 322 is pressurized, and thus can help ensure that the membrane 250 does not block the flow of the slurry 62 through the aperture 312 during a polishing operation. Alternatively or in addition, the upper surface 354 of the flange 354 can include channels or grooves. If the membrane 250 contacts the upper surface 354 then slurry can continue to flow through the channels or grooves.

Although FIG. 3 illustrates the passages 362 and 364 as emerging in a side wall of the rim 342 of the lower portion 340, other configurations are possible. For example, either or both passages 362 and 364 can emerge in the inner surface 354 of the flange 354 or even in the side wall 314 of the aperture 312.

5. The Drive System and Orbital Motion of the Pad

Figure 7:
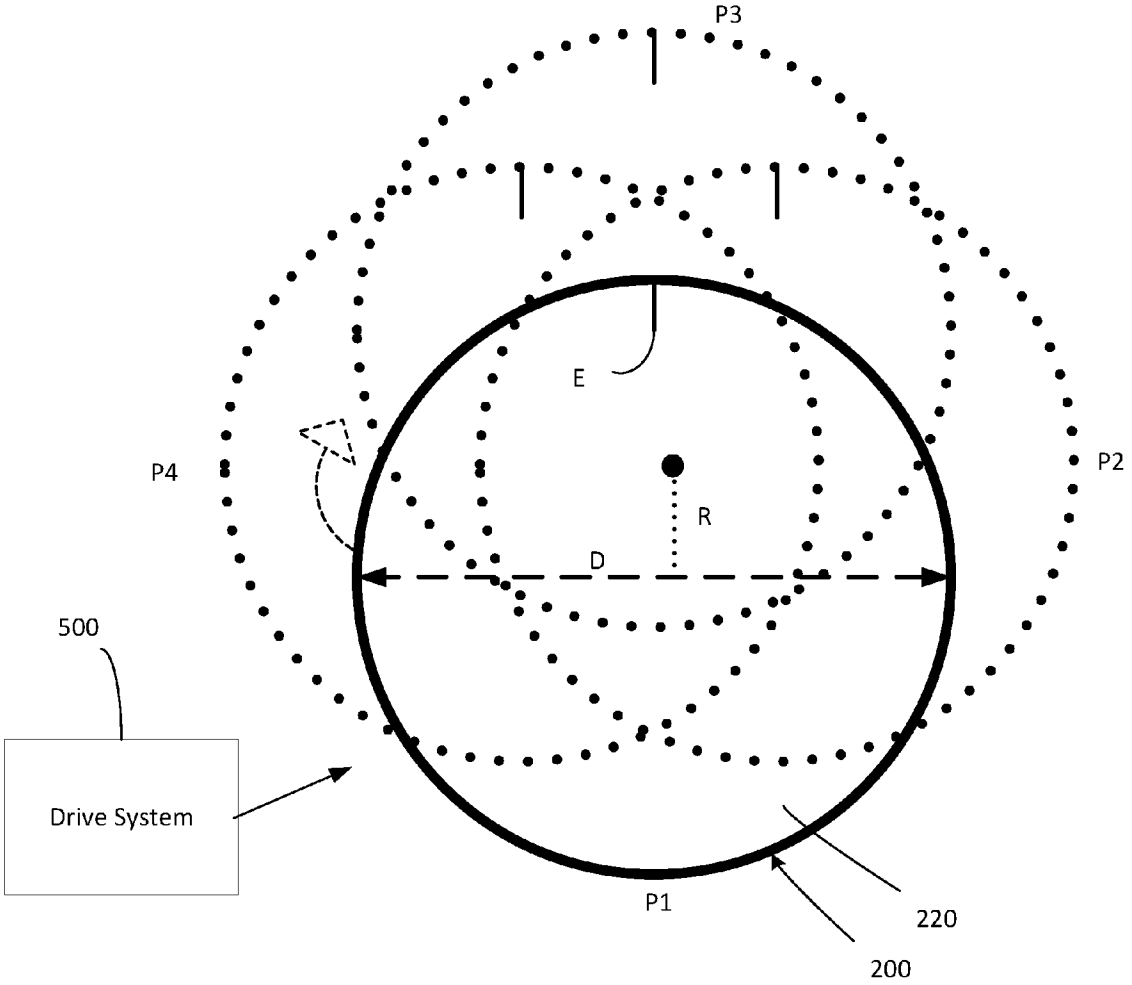
FIG. 7 is a schematic cross sectional top view illustrating a polishing pad portion that moves in an orbit while maintaining a fixed angular orientation.
Figure 8:
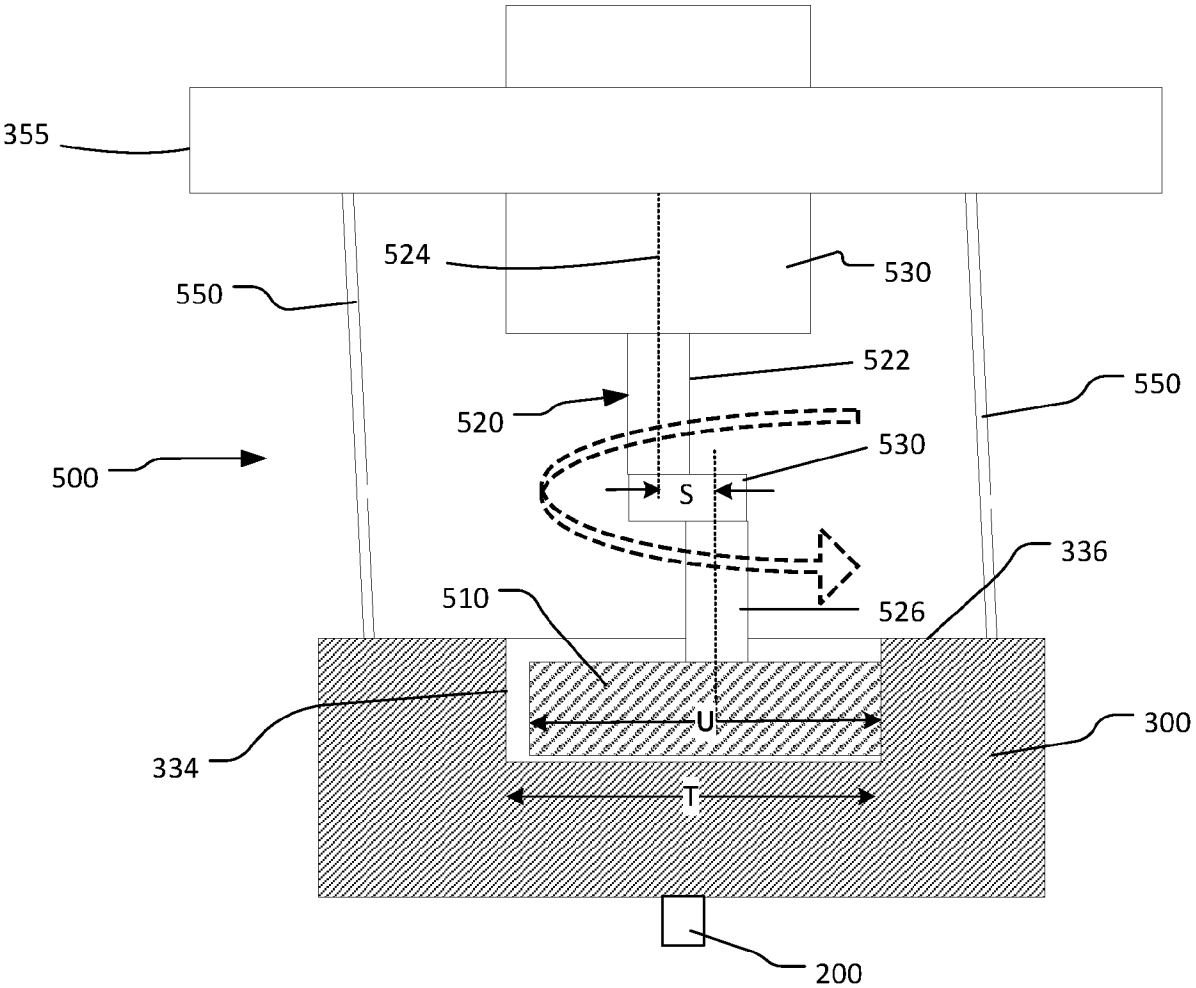
FIG. 8 is a schematic cross-sectional side view of the polishing pad carrier and drive train system of a polishing system.

Referring to FIGS. 1, 7 and 8, the polishing drive system 500 can be configured to move the coupled polishing pad carrier 300 and polishing pad portion 200 in an orbital motion during the polishing operation. In particular, as shown in FIG. 7, the polishing drive system 500 can be configured to maintain the polishing pad in a fixed angular orientation relative to the substrate during the polishing operation.

FIG. 7 illustrates an initial position P1 of the polishing pad portion 200. Additional positions P2, P3 and P4 of the polishing pad portion 200 at one-quarter, one-half, and three-quarters, respectively, of travel through the orbit are shown in phantom. As shown by position of edge marker E, the polishing pad remains in a fixed angular orientation relative during travel through the orbit.

Still referring to FIG. 7, the radius R of orbit of the polishing pad portion 200 in contact with the substrate can smaller than the largest lateral dimension D of the polishing pad portion 200. In some implementations, the radius R of orbit of the polishing pad portion 200 is smaller than the smallest lateral dimension of the contact area. In the case of a circular polishing area, the largest lateral dimension D of the polishing pad portion 200. For example, the radius of orbital can be about 5-50%, e.g., 5-20%, of the largest lateral dimension of the polishing pad portion 200. For a polishing pad portion that is 20 to 30 mm across, the radius of orbit can be 1-6 mm. This achieves a more uniform velocity profile in the contact area of the polishing pad portion 200 against the substrate. The polishing pad should preferably orbit at a rate of 1,000 to 5,000 revolutions per minute ("rpm").

Referring to FIGS. 1, 6, and 8 the drive train of the polishing drive system 500 can achieves orbital motion with a single actuator 540, e.g., a rotary actuator. A circular recess 334 can be formed in the upper surface 336 of the casing 310, e.g., in the top surface of the upper portion 330. A circular rotor 510 having a diameter equal to or less than that of the recess 334 fits inside the recess 334, but is free to rotate relative to the polishing pad carrier 300. The rotor 510 is connected to a motor 530 by an offset drive shaft 520. The motor 530 can be suspended from the support structure 355, and can be attached to and move with the moving portion of the positioning drive system 560.

The offset drive shaft 520 can include an upper drive shaft portion 522 that is connected to the motor 540 rotates about an axis 524. The drive shaft 520 also includes a lower drive shaft portion 526 that is connected to the upper drive shaft 522 but laterally offset from the upper drive shaft 522, e.g., by a horizontally extending portion 528.

In operation, rotation of the upper drive shaft 522 causes the lower drive shaft 526 and the rotor 510 to both orbit and rotate. Contact of the rotor 510 against the inside surface of the recess 334 of the casing 310 forces the polishing pad carrier 300 to undergo a similar orbital motion.

Assuming the lower drive shaft 520 connects to the center of the rotor 510, the lower drive shaft 520 can be offset from the upper drive shaft 522 by a distance S that provides a desired radius R of orbit. In particular, if the offset causes the lower drive shaft 522 to revolve in a circle with a radius S, the diameter of the recess 344 is T, and the diameter of the rotor is U, then $$R = S - \left(\frac{T - U}{2}\right)$$

A plurality of anti-rotation links 550, e.g., four links, extend from the positioning drive system 560 to the polishing pad carrier 300 to prevent rotation of the polishing pad carrier 300. The anti-rotation links 550 can be rods that fit into receiving holes in the polishing pad carrier 300 and support structure 500. The rods can be formed of a material, e.g., Nylon, that flexes but generally does not elongate. As such, the rods are capable of slight flexing to permit the orbital motion of the polishing pad carrier 300 but prevent rotation. Thus, the anti-rotation links 550, in conjunction with motion of the rotor 510, achieve an orbital motion of the polishing pad carrier 300 and the polishing pad portion 200 in which the angular orientation of the polishing pad carrier 300 and the polishing pad portion 200 does not change during the polishing operation. An advantage of orbital motion is a more uniform velocity profile, and thus more uniform polishing, than simple rotation. In some implementations, the anti-rotation links 550 can be spaced at equal angular intervals around the center of the polishing pad carrier 300.

In some implementations, the polishing drive system and the positioning drive system are provided by the same components. For example, a single drive system can include two linear actuators configured to move the pad support head in two perpendicular directions. For positioning, the controller can cause the actuators to move the pad support to the desired position on the substrate. For polishing, the controller can cause the actuators to move the pad support in the orbital motion, e.g., by applying phase offset sinusoidal signals to the two actuators.

In some implementations, the polishing drive system can include two rotary actuators. For example, the polishing pad support can be suspended from a first rotary actuator, which in turn is suspended from a second rotary actuator. During the polishing operation, the second rotary actuator rotates an arm that sweeps the polishing pad carrier in the orbital motion. The first rotary actuator rotates, e.g., in the opposite direction but at the same rotation rate as the second rotary actuator, to cancel out the rotational motion such that the polishing pad assembly orbits while remaining in a substantially fixed angular position relative to the substrate.

6. Conclusion

The size of a spot of non-uniformity on the substrate will dictate the ideal size of the loading area during polishing of that spot. If the loading area is too large, correction of underpolishing of some areas on the substrate can result in overpolishing of other areas. On the other hand, if the loading area is too small, the pad will need to be moved across the substrate to cover the underpolished area, thus decreasing throughput. Thus, this implementation permits the loading area to be matched to the size of the spot.

Figure 9:
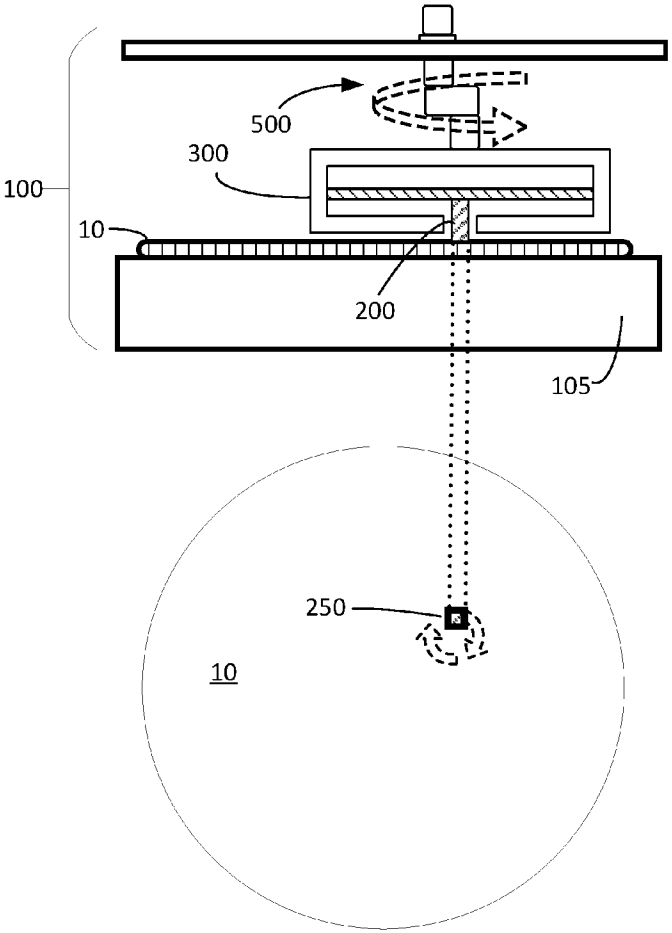
FIG. 9 is a schematic cross-sectional and top view illustrating orbital motion of the polishing pad portion relative to the substrate.

Referring to FIG. 9, the polishing surface 250 of the polishing pad portion 200 can undergo orbital motion relative to the substrate 10. In contrast with rotation, an orbital motion that maintains a fixed orientation of the polishing pad relative to the substrate provide a more uniform polishing rate across the region being polished.

Figure 10:
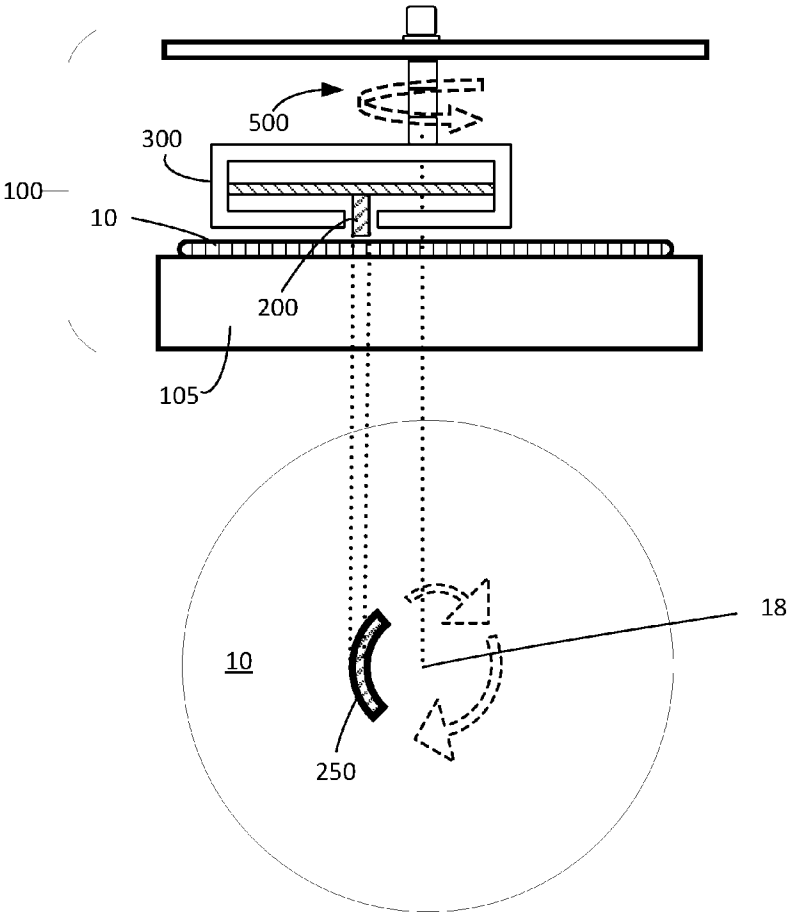
FIG. 10 is a schematic cross-sectional and top view illustrating rotational motion of the polishing pad portion relative to the substrate.

Although orbital motion is described above, there can be some implementations in which rotary motion is desirable. For example, as shown in FIG. 10, the drive system 500 can rotate the polishing pad portion 200 around a center 18 of the substrate 10. This implementation may be advantageous if the non-uniformity on the substrate is radially symmetric. The polishing pad portion 200 can have the arc-shaped geometry illustrated in FIG. 4B. The arc of the polishing pad portion 200 may be such that the radial center of the arc corresponds to the center of the substrate 10. An advantage of this configuration is that the polishing pad portion 200 can be made larger by stretching further around the region that requires polishing, and thus achieve a higher polishing rate, without sacrificing radial precision.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers.

A number of embodiments of the invention have been described. Nevertheless, it will be understood that various modifications may be made without departing from the spirit and scope of the invention. For example, the substrate support could, in some embodiments, include its own actuators capable of moving the substrate into position relative to the polishing pad. As another example, although the system described above includes a drive system that moves the polishing pad in the orbital path while the substrate is held in a substantially fixed position, instead the polishing pad could be held in a substantially fixed position and the substrate moved in the orbital path. In this situation, the polishing drive system could be similar, but coupled to the substrate support rather than the polishing pad support.

Although generally circular substrate is assumed, this is not required and the support and/or polishing pad could be other shapes such as rectangular (in this case, discussion of "radius" or "diameter" would generally apply to a lateral dimension along a major axis).

Terms of relative positioning are used to denote positioning of components of the system relative to each other, not necessarily with respect to gravity; it should be understood that the polishing surface and substrate can be held in a vertical orientation or some other orientations. However, the arrangement relative to gravity with the aperture in the bottom of the casing can be particular advantageous in that gravity can assist the flow of slurry out of the casing.

Accordingly, other embodiments are within the scope of the following claims.

What is claimed is:

1. A chemical mechanical polishing system, comprising:

a substrate support configured to hold a substrate during a polishing operation;

a polishing pad assembly include a membrane and a polishing pad portion, the polishing pad portion having a polishing surface to contact the substrate during the polishing operation, the polishing pad portion joined to the membrane on a side opposite the polishing surface;

a polishing pad carrier comprising a casing having a cavity and an aperture connecting the cavity to an exterior of the casing, the polishing pad assembly positioned in the casing such that the membrane divides the cavity into a first chamber and a second chamber and the aperture extends from the second chamber, and wherein the polishing pad carrier and polishing pad assembly are positioned and configured such that at least during application of a sufficient pressure to the first chamber the polishing pad portion projects through the aperture; and a drive system configured to cause relative motion between the substrate support and the polishing pad carrier.

2. The system of claim 1, wherein the membrane and the polishing pad portion are a unitary body.

3. The system of claim 1, wherein the polishing pad portion is secured to the membrane by an adhesive.

4. The system of claim 1, wherein the membrane comprises a first portion surrounded by a less flexible second portion, and the polishing pad portion is joined to the first portion.

5. The system of claim 1, wherein an exterior surface of the polishing pad carrier surrounding the aperture is substantially parallel to the polishing surface.

6. The system of claim 1, wherein the polishing pad carrier and polishing pad assembly are configured such that when the first chamber is at atmospheric pressure the polishing pad portion extends at least partially through the aperture.

7. The system of claim 6, wherein the polishing pad carrier and polishing pad assembly are configured such that when the first chamber is at atmospheric pressure the polishing pad portion extends entirely through the aperture.

8. The system of claim 6, wherein the polishing pad carrier and polishing pad assembly are configured such that when the first chamber is at atmospheric pressure the polishing pad portion extends only partially through the aperture.

9. The system of claim 1, comprising a controllable pressure source fluidically coupled to the first chamber.

10. The system of claim 1, comprising a reservoir for polishing fluid, the reservoir fluidically coupled to the second chamber.

11. The system of claim 10, wherein the system is configured to cause the polishing fluid to flow into the second chamber and out of the aperture during a polishing operation.

12. The system of claim 1, comprising a source of cleaning fluid, the source of cleaning fluid fluidically coupled to the second chamber.

13. The system of claim 12, wherein the system is configured to cause the cleaning fluid to flow into the second chamber and out of the aperture between polishing operations.

14. The system of claim 1, wherein the casing comprises a lower portion that extends across substantially all of the membrane except at the aperture.

15. The system of claim 14, wherein the casing comprises an upper portion, and edges of the membrane are clamped between the upper portion and the lower portion of the casing.

16. The system of claim 1, wherein the membrane is substantially parallel to the polishing surface.

17. The system of claim 1, wherein the drive system is configured to move the polishing pad carrier in an orbital motion while the polishing pad portion is in contact with an exposed surface of the substrate and to maintain the polishing pad in a fixed angular orientation relative to the substrate during the orbital motion.

18. A polishing pad assembly, comprising:

a membrane having a perimeter with a kidney-bean shape; and a polishing pad portion having a polishing surface to contact a substrate during a polishing operation, the polishing pad portion joined to the membrane on a side opposite the polishing surface, the membrane extending beyond side walls of the polishing pad portion on all sides of the polishing pad portion.

19. The polishing pad assembly of claim 18, wherein the polishing pad portion is positioned about at a midline of the membrane and substantially equidistant from opposing edges of the membrane.

20. The polishing pad assembly of claim 18, wherein the membrane has bilateral symmetry across a midline of the membrane.

21. The polishing pad assembly of claim 18, wherein the polishing pad portion is arc-shaped.

* * * * *